US007581481B1

(12) United States Patent
Hornbeck et al.

(10) Patent No.: US 7,581,481 B1
(45) Date of Patent: Sep. 1, 2009

(54) CAPSULE FOR RELEASABLY RETAINING A MISSILE

(75) Inventors: William D. Hornbeck, Warwick, RI (US); Raymond A. St. Amand, Fairhaven, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 408 days.

(21) Appl. No.: 11/474,229

(22) Filed: Jun. 26, 2006

(51) Int. Cl.
*F41F 3/08* (2006.01)

(52) U.S. Cl. ..... 89/1.809; 89/1.82; 89/5

(58) Field of Classification Search ..... 89/1.801, 89/1.809, 1.816, 1.81, 1.82, 1.817, 5; 114/238, 114/320
See application file for complete search history.

(56) References Cited

U.S. PATENT DOCUMENTS 3,699,893 A * 10/1972 Meraz et al. ..... 102/262
3,853,149 A * 12/1974 Stine ..... 138/111
4,296,162 A * 10/1981 Jean ..... 428/213
4,321,297 A * 3/1982 Adelman ..... 428/292.7
4,357,855 A 11/1982 Merz
4,432,269 A 2/1984 Castagner et al.
4,514,945 A * 5/1985 Menchetti et al. ..... 52/202
4,699,077 A * 10/1987 Meadows et al. ..... 118/31.5
4,738,998 A * 4/1988 Uffner et al. ..... 524/69
4,772,507 A * 9/1988 Leo et al. ..... 428/218
4,884,489 A 12/1989 Zowarka et al.
5,620,095 A * 4/1997 Delmore et al. ..... 206/438
5,979,826 A * 11/1999 Brown et al. ..... 244/121
6,096,416 A * 8/2000 Altenberg ..... 428/317.7
6,427,574 B1 8/2002 Callahan
2003/0021934 A1 * 1/2003 Groft et al. ..... 428/40.1
2006/0096449 A1 * 5/2006 Williams et al. ..... 89/1.817

* cited by examiner

*Primary Examiner*—Michael Carone
*Assistant Examiner*—Jonathan C Weber
(74) *Attorney, Agent, or Firm*—James M. Kasischke; Jean-Paul A. Nasser; Michael P. Stanley

(57) ABSTRACT

A capsule adapted for disposition in a submarine launch tube for retaining the missile until launch thereof. The capsule includes a cylindrically shaped housing including a plurality of layers of glass fibers and layers of graphite, the layers including an outer layer of glass fibers defining an outer skin of the housing, and an inner layer of glass fibers. A titanium flange is fixed on the housing and in contact with the layers of graphite. An adhesive layer is disposed on the outer skin and an interface support pad is mounted on the outer skin and retained thereon by the adhesive layer. A layer of metal foil is disposed inboard of the adhesive layer and between the outer layer of glass fibers and the inner layer of glass fibers, to serve as a barrier to products of galvanic reaction occurring between the graphite layers and the titanium flange.

6 Claims, 5 Drawing Sheets

CAPSULE FOR RELEASABLY RETAINING A MISSILE

STATEMENT OF GOVERNMENT INTEREST

The invention described herein may be manufactured and used by or for the Government of the United States of America for governmental purposes without the payment of any royalty thereon or therefore.

BACKGROUND OF THE INVENTION

1. Field of the Invention

The invention relates to containers for submarine launched missiles and, more specifically, to a capsule for releasably retaining a missile, the capsule being adapted for disposition in a submarine launch tube and adapted to house the missile until launch thereof.

2. Description of the Prior Art

It is known to provide a capsule for retention of a missile, the capsule being adapted for disposition in a submarine launch tube. The capsule wall is made up of a composite of layers of graphite and glass fiber bonded with an epoxy resin. The layers, at their ends, abut titanium flanges. Urethane pads are adhesively bound to the outermost layer of glass fibers which forms the outer-skin of the capsule.

Experience has shown that contact between the graphite layers and the titanium flanges creates galvanic reaction within the composite wall. The reaction produces NaOH, and/or moisture and oxygen, which leaches out of the composite and deteriorates the adhesive bond between the urethane pads and the composite capsule, resulting in bond failures.

There is thus a need for a structure for preventing the NaOH and moisture and oxygen from contacting the adhesive layer binding the urethane pads to the capsule outer skin.

SUMMARY OF THE INVENTION

An object of the invention is, therefore, to provide an improved structure for the capsule composite wall, which structure prevents internally generated products of galvanic reaction from reaching the adhesive bonding the methane pads to the capsule outer skin.

With the above and other objects in view, a feature of the invention is the provision of a capsule for releasably retaining a missile, the capsule being adapted for disposition in a submarine vertical launch tube and for retaining the missile until launch thereof. The capsule comprises a cylindrically shaped housing made of a plurality of layers of glass fibers and layers of graphite, the layers including an outer layer of glass fibers defining an outer skin of the housing, and an inner layer of glass fibers disposed inboard of the outer layer of glass fibers. A titanium flange is fixed on the housing proximate either end thereof and in contact with the layers of graphite. An adhesive layer is disposed on the outer skin, and an interface support pad is mounted on the outer skin and retained thereon by the adhesive layer. A layer of metal foil is disposed inboard of the adhesive layer, and between the outer layer of glass fibers and the inner layer of glass fibers, to serve as a barrier to products of galvanic reaction occurring between the graphite layers and the titanium flange.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the drawings and wherein.

DESCRIPTION OF THE PREFERRED EMBODIMENTS

Figure 1:
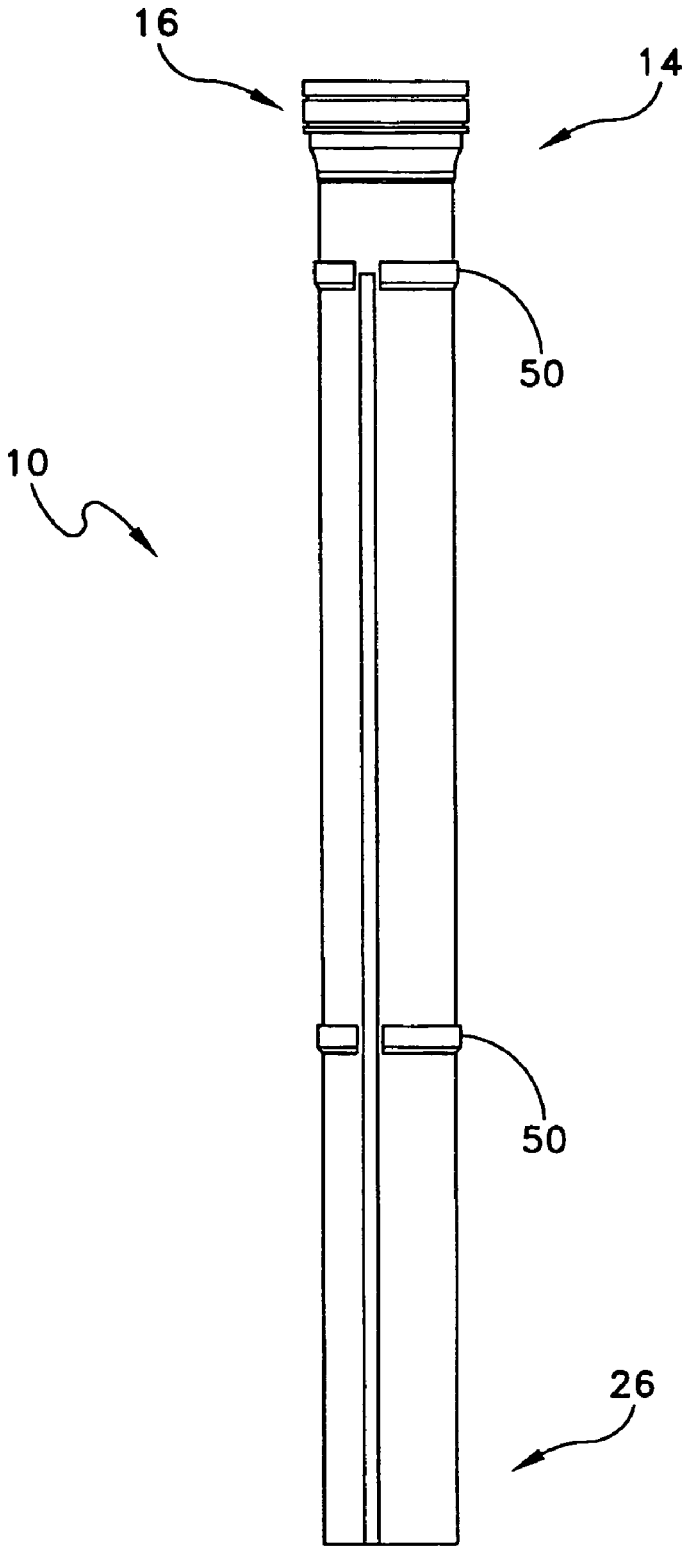
FIG. 1 (PRIOR ART)
FIG. 1 is a side elevational view of a capsule for releasably retaining a missile.

Referring to FIG. 1, it will be seen that a capsule 10 comprises an elongated cylindrically-shaped housing 12 which is adapted for disposition in a submarine vertical launch tube, or the like (not shown). The capsule 10 is adapted to house a missile (not shown) until the missile is launched from the capsule 10 and the submarine launch tube. The capsule 10 is configured to receive, carry, and support the launch of the missile.

Figure 2:
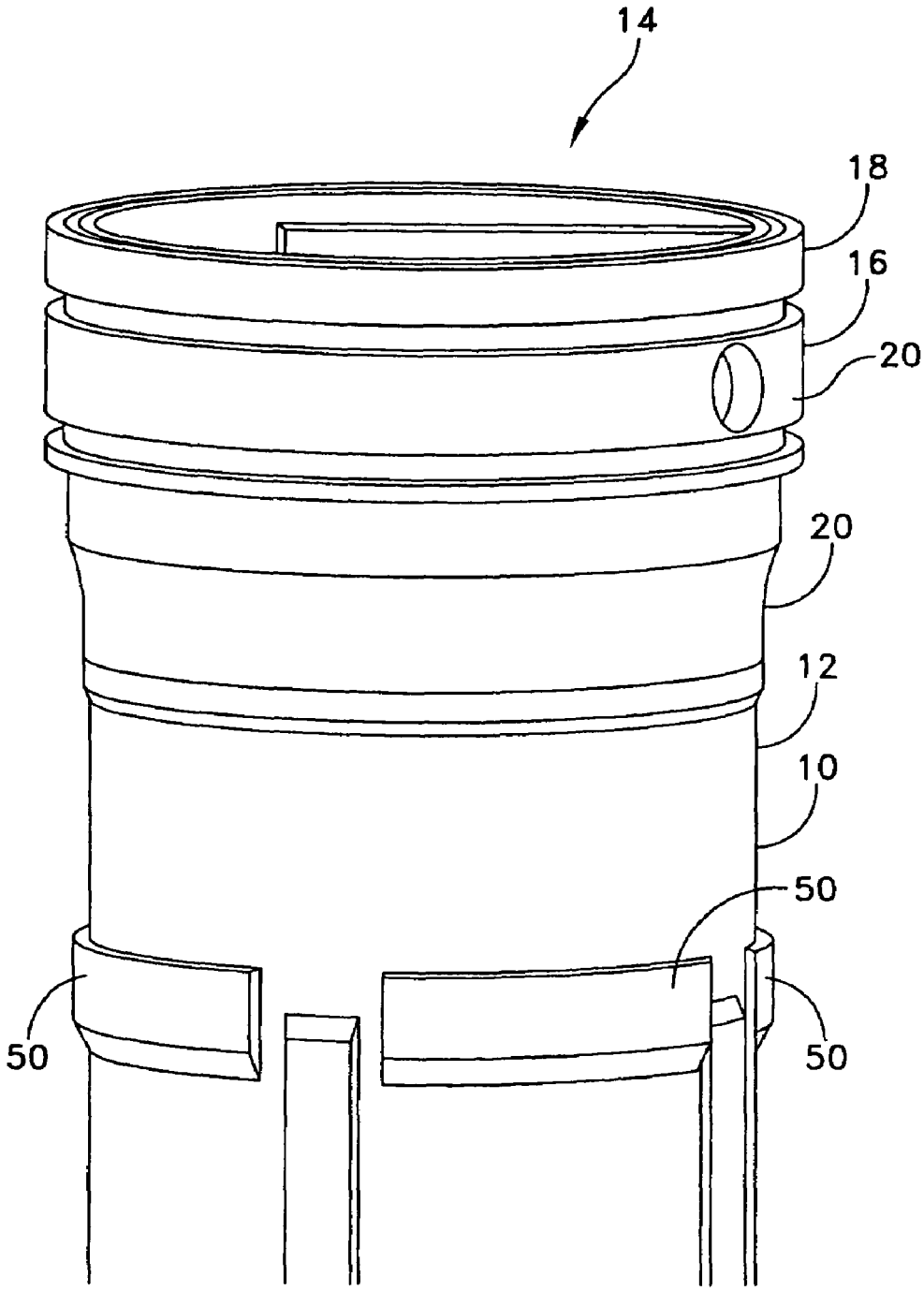
FIG. 2 (PRIOR ART)
FIG. 2 is an enlarged perspective view of a forward flange portion of the capsule of FIG. 1.
Figure 3:
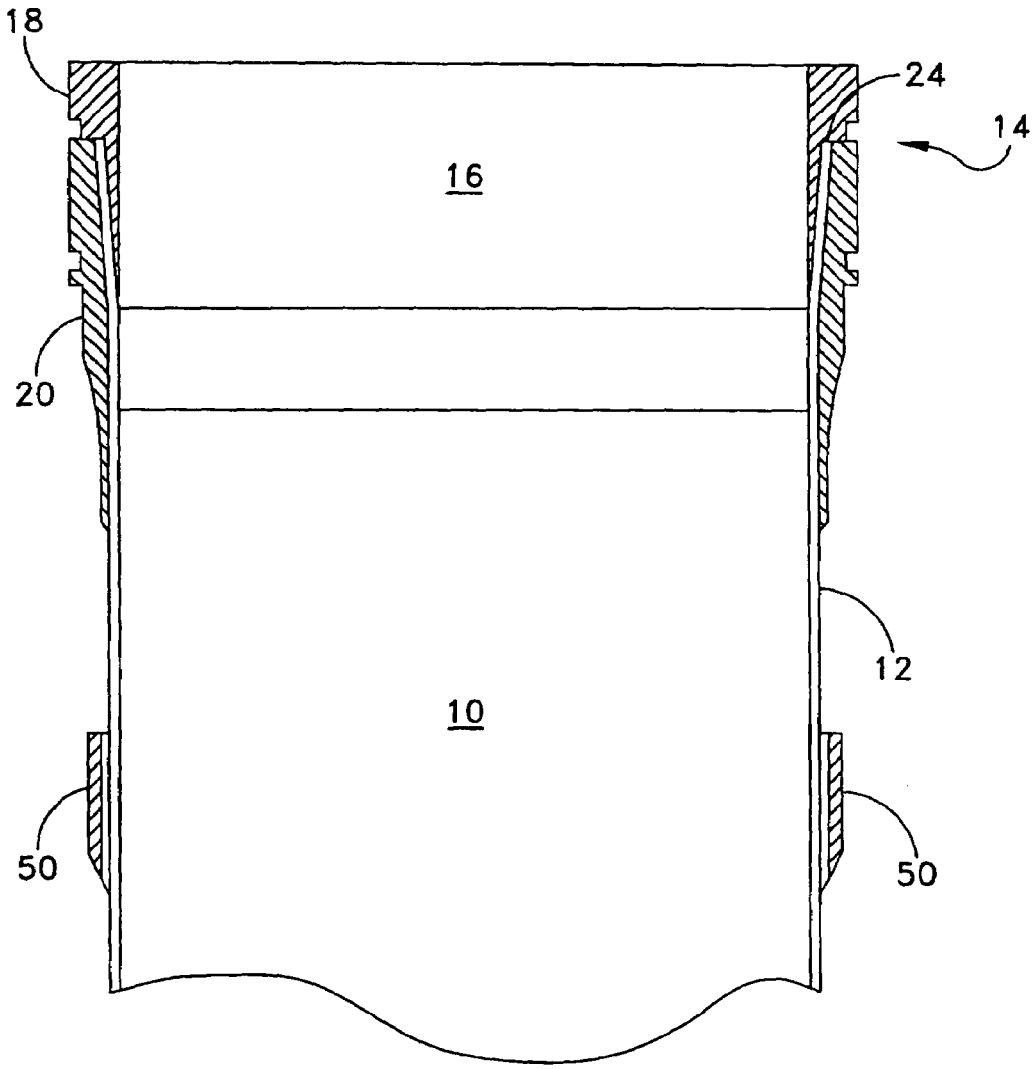
FIG. 3 (PRIOR ART)
FIG. 3 is a sectional view of the forward capsule portion and flange portion of FIG. 2.
Figure 4:
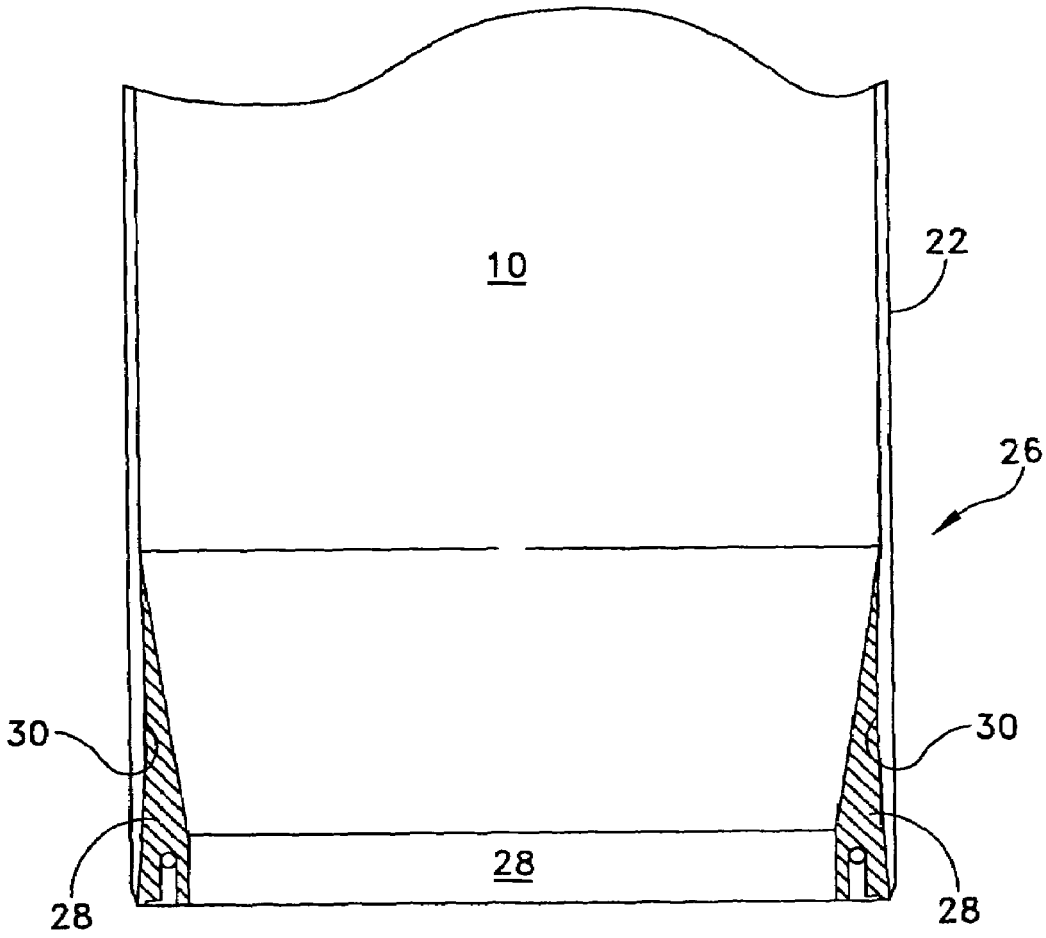
FIG. 4 (PRIOR ART)
FIG. 4 is a sectional view of an after capsule portion and flange portion of the capsule of FIG. 1.

Referring to FIG. 2, it will be seen that a forward end 14 of the capsule 10 includes a forward flange portion 16 which in turn includes an inner piece 18 and an outer piece 20. Sandwiched between the forward flange portion inner and outer pieces 18, 20 is a forward end 24 of a wall structure 22 defining the housing 12. A forward end 24 of the wall structure 22 abuts the inner piece 18 of the forward flange portion 16.

Similarly, an after end 26 of the capsule 10 includes an after flange portion 28 which abuts an after end 30 of the wall structure 22.

Figure 5:
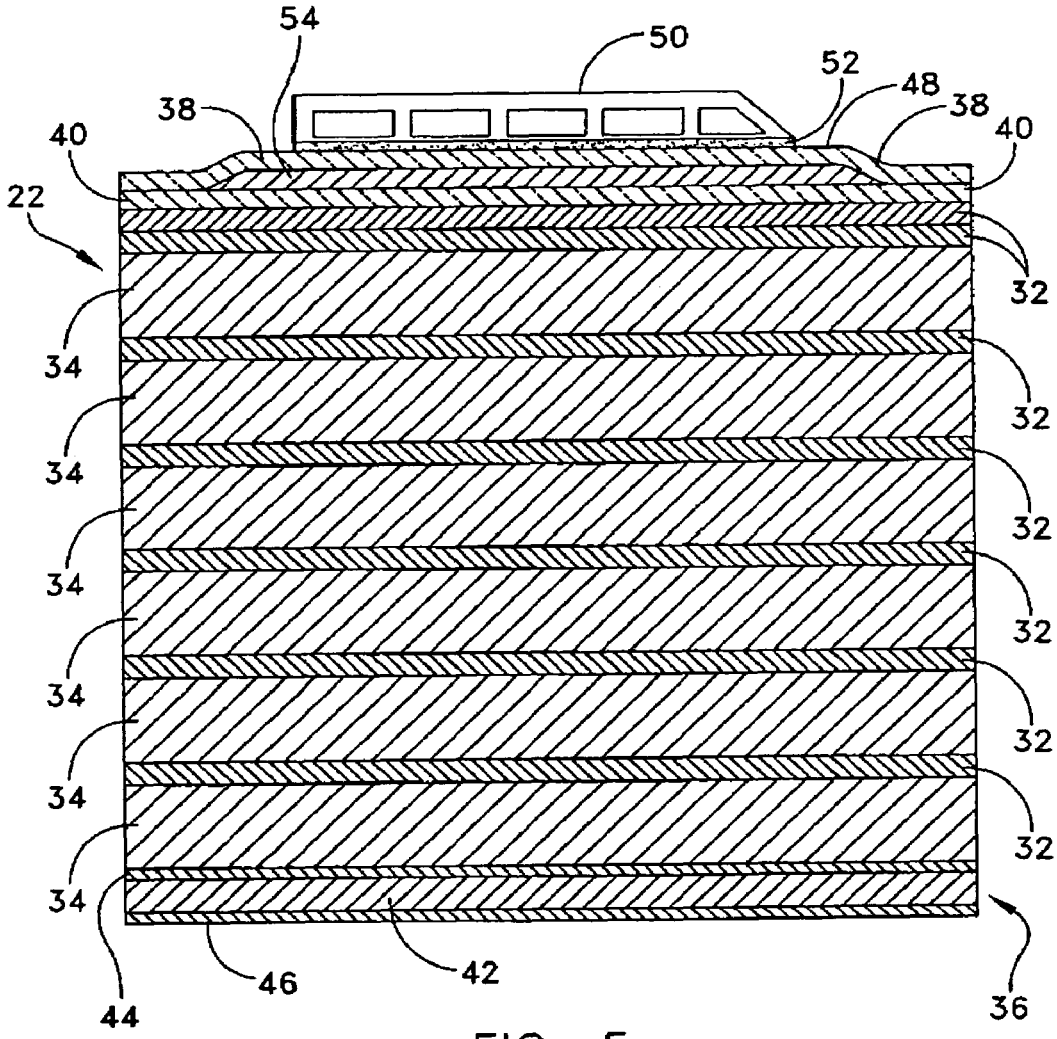
FIG. 5 is an enlarged, not-to-scale diagrammatic sectional view, taken through the composite skin of the capsule of FIG. 1.

Referring to FIG. 5, it will be seen that the wall structure 22 of the capsule 10 includes multiple alternating layers 32, 34 of graphite sandwiched between an inside layer 36 of moisture barrier material and an outer layer 38 of glass fibers. A second layer 40 of glass fibers underlies the outer layer 38. Additional layers (not shown) of glass fibers may be included in the composite. The graphite layers preferably comprise thin layers 32 of graphite and thicker layers 34 of graphite. The graphite and glass fiber layers are in combination with an epoxy matrix (not shown). The moisture barrier 36 preferably comprises a layer 42 of aluminum bound by inner and outer layers of glass cloth 44, 46.

At either end of the capsule 10 there is provided a titanium flange 16, 28, the flanges 16, 28 being in contact with the graphite layers 32, 34.

On the outer surface 48 of the outer layer 38 of glass fibers, there is mounted an interface support pad 50 bound to the outer surface 48 by a layer 52 of adhesive. It is the adhesive layer 52 that is potentially deleteriously affected by NaOH and/or moisture and/or oxygen derived from galvanic activity at the interfaces of graphite layers 32, 34 and flanges 16, 28.

In accordance with the invention, a metal foil 54 is disposed between the outer glass fiber layer 38 and another glass fiber layer there beneath, such as the layer 40. The metal foil 54 underlies the adhesive 52 and the interface support pad 50 and blocks movement of deleterious matter from the composite to the adhesive layer 52.

The interface support pads 50 abut the inside surfaces of a launch tube (not shown). The pads 50, when viewed axially along the capsule, are of arcuate configuration such that a base thereof coincides with the surface configuration of the capsule 10, and the outer surface thereof coincides with the internal curvature of the launch tube. Thus, the support pads 50 serve to maintain the capsule 10 centered in the launch tube. One set of pads 50 is disposed proximate a forward end 14 of the capsule 10 and a second set of pads 50 is disposed nearer the after end 26 of the capsule 10. Each set typically includes four equally spaced and equally sized pads arranged circumferentially around the capsule. The metal foil 54 may comprise a discrete foil member underlying each pad or a belt of foil underlying all the pads of a set of pads 50, wherein the metal foil 54 is of arcuate configuration such that a base surface thereof coincides with the surface configuration of the capsule 10, and the outer surface thereof coincides with the internal curvature of the launch tube.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A capsule for releasably retaining a missile, the capsule being adapted for disposition in a submarine launch tube and for retaining the missile until launch thereof, the capsule comprising:

a cylindrically shaped housing comprising a plurality of layers of glass fibers and layers of graphite, said layers including an outer layer of glass fibers defining an outer skin of the housing, and an inner layer of glass fibers disposed inboard of the outer layer of glass fibers;

a titanium flange fixed on said housing and in contact with the layers of graphite;

an adhesive layer disposed on the outer skin;

an interface support pad mounted on the outer skin and retained thereon by said adhesive layer; and a layer of metal foil disposed inboard of the adhesive layer and between the outer layer of glass fibers and the inner layer of glass fibers, whereby to serve as a barrier to products of galvanic reaction occurring between the graphite layers and the titanium flange.

2. The capsule in accordance with claim 1, wherein said layer of metal foil extends width-wise around the capsule and underlies a plurality of spaced-apart support pads.

3. The capsule in accordance with claim 1, wherein said layer of metal foil comprises a belt extending around the capsule.

4. The capsule in accordance with claim 1, wherein said support pads are of urethane material.

5. The capsule in accordance with claim 2, wherein said layer of metal foil comprises a discrete metal foil member underlying each of said support pads.

6. The capsule in accordance with claim 5 wherein a base portion of each interface support pad is of an arcuate configuration and each of said metal foil members is of an arcuate configuration and underlies one of said support pads.

* * * * *